United States Patent [19]

Kölling et al.

[11] 3,997,654

[45] Dec. 14, 1976

[54] METHOD FOR THE PRODUCTION OF CARBONACEOUS ARTICLES, PARTICULARLY STRANDS

[75] Inventors: Georg Kölling, Essen; Ingo Romey, Drevenack, both of Germany

[73] Assignee: Bergwerksverband GmbH, Essen, Germany

[22] Filed: Apr. 22, 1975

[21] Appl. No.: 570,458

[30] Foreign Application Priority Data

Apr. 24, 1974 Germany ..... 2419659

[52] U.S. Cl. ..... 423/447.4; 264/29.2; 423/448; 423/449

[51] Int. Cl.[2] ..... C01B 31/02; C01B 31/07

[58] Field of Search ..... 423/447, 448, 449, 447.4; 264/29

[56] References Cited

UNITED STATES PATENTS

| | | | |
|---|---|---|---|
| 3,392,216 | 7/1968 | Otani | 423/447 X |
| 3,508,874 | 4/1970 | Rulison | 423/447.4 |
| 3,595,946 | 7/1971 | Joo et al. | 423/447 X |
| 3,629,379 | 12/1971 | Otani | 423/447 |
| 3,702,054 | 11/1972 | Araki et al. | 423/447 X |
| 3,803,672 | 4/1974 | McGuffin et al. | 423/447 X |

OTHER PUBLICATIONS

Shea et al. "Chemical Abstract" vol. 77, 1972, 49993e.

*Primary Examiner*—Edward J. Meros
*Attorney, Agent, or Firm*—Michael J. Striker

[57] ABSTRACT

Pitch having a Kramer-Sarnow softening point between 70° and 190° C is heated to a temperature in the range of 40° to 100° C above the softening point thereof. There is thus obtained a molten mass having non-molten particles distributed therein. A filtering operation under a pressure greater than atmospheric pressure is carried out to remove the particles from the molten mass. The molten mass may then be treated in different ways. According to one embodiment, the molten mass is held at a temperature between 280° and 350° C to distill off low molecular weight components of the pitch and the resulting product is thereafter shaped by extrusion to the form of strands. According to another embodiment, the molten mass is cooled, ground to particulate form and contacted with an aliphatic solvent having a boiling point between 60° and 70° C. This solvent dissolves a portion of the ground mass and, after separation of the solvent from the residue, the latter is heated to a molten state and thereafter extruded into the form of strands. In either embodiment, the previously mentioned filtering operation provides for a greater homogeneity of the strands since the non-molten particles, which could form a second phase, are substantially completely eliminated. In both embodiments, the strands obtained are dusted with finely divided activated carbon which has been impregnated with a liquid oxidizing agent. The dusted strands are oxidized in an oxidizing atmosphere at temperatures between 300° and 400° C. The oxidation increases the melt-resistance of the strands. The oxidized strands are next carbonized, the increased melt-resistance thereof preventing melting of the strands during the carbonizing treatment. If desired, the strands may also be graphitized. The method described enables carbon-containing or graphite-containing strands suitable for many applications to be produced in a much shorter time than was possible heretofore.

10 Claims, No Drawings

METHOD FOR THE PRODUCTION OF CARBONACEOUS ARTICLES, PARTICULARLY STRANDS

BACKGROUND OF THE INVENTION

The invention relates generally to the production of carbon-containing or graphite-containing articles, that is, carbonaceous articles. Of particular interest to the invention is a method for the production of carbonaceous strands from pitch.

It is known to heat coal-tar pitch having a softening point (as determined in accordance with the ASTM standards) between 70 and 250° C to a temperature above the softening point and up to about 300° C and to filter the pitch at this temperature. If necessary, the pitch may be thinned with an aromatic solvent prior to heating thereof. The filtering operation is intended to remove from the pitch all of that material which is insoluble in quinoline (a constituent of coal tar) so as to prevent the appearance of a second phase in the subsequently formed articles. The thus-pretreated pitch is then heat treated and distilled at a temperature between 280° and 305° C in order to remove the low molecular weight components thereof. Subsequently, the pitch is annealed at similar temperatures for a period of 10 to 100 hours. The molten pitch is then extruded to the form of strands which are oxidized with an oxidizing gas and thereafter carbonized. The strands obtained by the extrusion of coal-tar pitch which has been treated in the above manner require a total dwell time of about 178 hours for their oxidation and further require a total dwell time of about 182 hours for their carbonization, that is, the strands require a total treatment time of about 360 hours. While it is true that the individual carbon fibers produced under these known working conditions possess tensile strengths of the order of 7000 to 9000 kilograms per square centimeter, there is nevertheless the disadvantage that the long heat treatments necessary for the production thereof require a substantial expenditure of time as well as a substantial expenditure of energy.

The method just outlined is described in the German Auslegeschrift No. 1,925,609. From the German Offenlegungsschrift 2,124,636, it is further known to heat bituminous coal-tar pitch having a Kramer-Sarnow softening point of 80° to 190° C and to filter the molten pitch in order to remove the solid and pseudo-solid particles which are naturally present in the pitch. After the filtration, a polymeric hydrocarbon is added to the molten pitch and a thermal treatment at a maximum temperature of 420° C is carried out while passing through a stream of nitrogen. Subsequent to the thermal treatment, the molten pitch is extruded into the form of strands, the extrusion being followed by the oxidation of the strands in the presence of air and the carbonization of the strands in a stream of nitrogen. Although the treatment time for the method just described represents an improvement over that for the first method outlined, the total treatment time for the strands in the last-described known method nevertheless is still 25 hours when using briquetted soft pitch.

Another method for the production of carbon-containing strands is known from the German Offenlegungsschrift No. 2,153,567. Here, coal-tar pitch having a softening point (as determined in accordance with the ASTM standards) of about 187° C is ground to the form of small particles and then brought into contact with an essentially aromatic or equivalent solvent in order to dissolve about 10 to 30% of the pitch. A filtering operation is carried out and the residue thus obtained is subjected to an extraction with a second solvent in order to dissolve at least 45% of the pitch as calculated on the original quantity of the starting pitch. After filtering once more and removing the solvent by evaporation, a pitch which is suitable for extrusion in the molten state is obtained. However, long oxidation and carbonization periods are necessary with this pitch also.

It will, therefore, be appreciated that improvements in the state of the art are desirable.

SUMMARY OF THE INVENTION

A general object of the invention is to provide a novel method for the production of carbonaceous articles.

Another object of the invention is to provide a method which enables carbonaceous articles to be produced in shorter periods of time than were possible heretofore.

A further object of the invention is to provide a method which enables readily extrudable materials capable of being oxidized and carbonized in the shortest time spans to be produced from coal-tar pitch and which, concomitantly, enables carbonaceous strands suitable for many applications to be obtained.

These objects, as well as others which will become apparent hereinafter, are achieved in accordance with the invention. According to one aspect of the invention, there is provided a method for the production of carbonaceous articles wherein pitch is heated to such a temperature above its softening point that a first part of the pitch becomes molten and a second part of the pitch is in the form of substantially non-molten particles. The resulting molten mass is separated from at least the major part of the particles so as to cause the first part of the pitch to become more homogeneous. At least the first part of the pitch is treated so as to increase the molecular weight thereof. The first part of the pitch is shaped subsequent to this treatment, and subsequent to the separation of at least the major part of the particles therefrom, so as to form at least one article. The latter is contacted with finely divided activated carbon which is impregnated with an oxidizing agent. The article is oxidized in the presence of the activated carbon so as to increase the melt-resistance of the article and the article is carbonized.

The treatment of the first part of the pitch so as to increase the molecular weight thereof is favorably carried out subsequent to the operation of separating the substantially non-molten particles therefrom. This treatment advantageously involves subjecting the first part of the pitch to a distillation at temperatures between about 280° and 350° C so as to effect removal of low molecular weight components of the pitch from the first part of the latter.

In accordance with another aspect of the invention, there is provided a method for the production of carbonaceous articles wherein pitch is heated to such a temperature above its softening point that a first part of the pitch, which includes at least one portion substantially insoluble in aliphatic solvents, becomes molten and a second part of the pitch is in the form of substantially non-molten particles. The resulting molten mass is separated from at least the major part of the particles so as to cause the aliphatic solvent-insoluble portion of the first part of the pitch to become more homogeneous. Here, at least the first part of the pitch is contacted with an aliphatic solvent so as to dissolve another portion of the first part of the pitch which is soluble in aliphatic solvents. The aliphatic solvent-insoluble portion of the first part of the pitch is shaped so as to form at least one article, the shaping being effected subsequent to the separation of at least the major part of the substantially non-molten particles from the aliphatic solvent-insoluble portion and subsequent to contacting the first part of the pitch with the aliphatic solvent. The thus-obtained article is contacted with finely divided activated carbon which is impregnated with an oxidizing agent. The article is oxidized in the presence of the activated carbon so as to increase the melt-resistance of the article and the article is carbonized.

The first part of the pitch is favorably contacted with the aliphatic solvent subsequent to the separation of the substantially non-molten particles. The aliphatic solvent used advantageously has a boiling point between about 60° and 70° C.

In the aspect of the invention where the first part of the pitch is contacted with an aliphatic solvent, it is preferred to cool the first part of the pitch subsequent to the separation of at least the major part of the substantially non-molten particles, to then grind the first part of the pitch to the form of small particles and to thereafter contact the first part of the pitch, that is, the ground particles, with the aliphatic solvent. Favorably, at least the major part of the aliphatic solvent is separated from the aliphatic solvent-insoluble portion of the first part of the pitch prior to the shaping operation.

The article obtained according to either aspect of the invention may be graphitized if desired.

According to the invention, the pitch which is used may comprise coal-tar pitch. It is preferred when the pitch is a hard pitch having a Kramer-Sarnow softening point between about 70° and 190° C. Advantageously, the heating of the pitch so that a first part thereof becomes molten while a second part thereof is in the form of substantially non-molten particles involves raising the temperature of the pitch to the range of about 40° to 100° C above the softening point thereof. It is particularly favorable for the separation of the substantially non-molten particles to be carried out while the molten material resulting from the heating has a temperature in this range.

A preferred embodiment of the invention contemplates for the separation of the substantially non-molten particles and the molten material to involve filtering under a pressure greater than atmospheric pressure. In this manner, a substantially complete separation of the molten material and the particles may be effected.

The shaped article or articles obtained from the pitch may, for instance, be in the form of a strand or strands, e.g. fibers or filaments. The shaping operation used to form the article or articles may involve extrusion. It is preferred for the extrusion to be effected while the material being extruded is in a molten state.

The activated carbon with which the shaped article is contacted may be impregnated with a liquid oxidizing agent. Suitable oxidizing agents include the nitroaromatic compounds and compounds such as, for instance, sulfuric acid, which are capable of generating oxidizing gases. The impregnated activated carbon is favorably dusted or sprinkled over the shaped article.

The oxidation of the shaped article is advantageously carried out in an oxidizing atmosphere. Preferably, the oxidizing treatment is effected at temperatures between about 300° and 400° C.

DESCRIPTION OF THE PREFERRRED EMBODIMENTS

Of particular interest to the invention is a method for the production of carbon or graphite strands, e.g. fibers or filaments, from coal-tar pitch wherein the pitch is extruded while in a molten state and the thus-obtained strands are subjected to an oxidation and then to a carbonization and, if necessary or desired, to a graphitization.

According to one advantageous embodiment, the objects of the invention are achieved by a combination of the following measures:

a. Hard pitch having a Kramer-Sarnow softening point between about 70° and 190° C is heated, prior to the extrusion, to a temperature which lies 40° to 100° C above the softening point. The pitch melt thus obtained is filtered at this temperature under a pressure greater than atmospheric pressure in order to remove essentially the total content of solid particles.

b. the filtered melt is subjected to a distillation at temperatures between about 280° and 350° C in order to remove pitch components of low molecular weight.

c. Prior to the carbonization, the strands extruded from the pitch melt are dusted with finely divided activated carbon which is impregnated with liquid oxidizing agents and heated to temperatures between about 300° and 400° C in oxidizing atmospheres.

The hard pitch used for the invention may have been previously subjected to an oxidizing thermal treatment in known manner. In the method according to the invention, not only are the soot and ash particles of such a hard pitch separated by virtue of the filtration but a portion of the polymerizate formed during the previous treatment is also separated as a result of the filtration. Prior to the filtration, known filter aids such as diatomaceous earth, e.g. Kieselguhr, may be mixed into the hot pitch melt in conventional manner. The hot pitch melt may, for example, have a temperature between about 130° and 290° C when the filter aid is mixed in. The pitch may, for instance, be heated in a pressure vessel, which is itself heated by means of heat-exchange oil, and the pressure in the interior of the vessel may rise to a value of 10 atmospheres in excess of atmospheric pressure.

The filtering operation may be carried out with known pressure filtering arrangements. Paper sliver filters, or also metallic filters of bronze or corrosion-resistant steel, having openings of an average diameter of up to approximately 3.5 microns, may be used for the filtering operation. In order to prevent oxidation of the pitch during the pressure filtration, the pitch melt may be pressed through the filter by means of nitrogen. The nitrogen may, for example, have a pressure of about 5 atmospheres in excess of atmospheric pressure. Although up to approximately 90% of the ash components present in the pitch melt may have a finesse of 1 to 2 microns, the pitch melt can nevertheless, according to the invention, be substantially completely freed from solid components during the pressure filtration by means of, for instance, a paper sliver filter having openings of an average diameter of 3.4 microns. The reason is that ash particles already adhere to the filter aid in the pitch melt thus combining with one another to form larger assemblies. The filtering pressure and the diameter of the openings of the filter vary in dependence upon the viscosity of the pitch melt at the temperature selected for the filtration.

Surprisingly, by virtue of the filtration in accordance with the invention, such carbon-rich, high molecular weight components are retained in the pitch that, as opposed to the known methods, a substantially shortened production time for the strands becomes possible.

The coal-tar pitch which has been pretreated as above is then heat treated and distilled at a temperature in the range of about 280° to 350° C in order to remove its low molecular weight components. This may be accomplished in accordance with known prodecures such as, for instance, by means of steam distillation or under reduced pressure. The distillation may be carried out for a period of 2 to 5 hours and, advantageously, 3 to 4 hours.

The heat treated coal-tar pitch, which has been produced in the manner described, is then extruded to the form of strands through a nozzle or an extrusion head. For the purpose of extrusion, the pitch is kept in or brought into a molten state by adjusting the temperature thereof so as to lie between the softening point of the pitch and approximately 300° C. The molten pitch is pressed through the opening of the extrusion head by means of nitrogen having a sufficient pressure. It is also possible to extrude the molten pitch through the opening of the extrusion head by means of a ram or the like or by means of other known arrangements. The pressure and temperature used for the extrusion depend upon the properties of the treated coal-tar pitch. The strands produced issue into the air and are extended.

Prior to the carbonization, the strands are subjected to an oxidation process in order to generate the infusibility which is necessary for the subsequent carbonization.

For the oxidizizing treatment, the strands are, in accordance with the invention, dusted or sprinkled with finely divided activated carbon which has been impregnated with a liquid oxidizing agent. Suitable oxidizing agents for this purpose are, for example, nitroaromatic compounds such as nitrobenzene, nitrotoluene and nitrophenol as well as liquid compounds such as, for instance, sulfuric acid, which form oxidizing gases. By virtue of the dusting or sprinkling of the strands with the activated carbon powder, it becomes possible, on the one hand, to prevent the strands from agglomerating during the following critical heating while, on the other hand, there is achieved the result that the oxidizing process is completed in a very short period of time. The heating of the dusted strands from a temperature of 20° C to a temperature of 350° C may, for example, be carried out in approximately 20 minutes in many instances, with the re-solidification of the strands already having begun. Due to the large inner surface area of the activated carbon, a large excess quantity of the oxidizing agent may be brought immediately adjacent the strands. As a result, an extremely rapid oxidation of the surfaces of the strands occurs, which oxidation is brought to completion by the subsequent thermal oxidizing treatment. In accordance with the invention, it thus becomes possible to achieve a regulated and retarded application of the oxidizing agent on the surfaces of the strands since an increased liberation of the oxidizing agent occurs with increasing temperature. The strands are, accordingly, already resolidified after an elapsed time of approximately 20 minutes.

When using the oxidizing treatment according to the invention, the subsequent carbonization requires a period of only about 5 to 10 minutes in order to treat the strands at temperatures of up to approximately 1000° C.

Another advantageous embodiment of the invention resides in a variation of the method according to the combination of measures described above. Here, instead of the distillation in the stage (b), the product obtained by filtration from the stage (a) is ground to the form of small pitch particles subsequent to cooling. The particles are brought into contact with an essentially aliphatic solvent having a boiling point between about 60° and 70° C. Thereafter, the solvent is removed from the insoluble pitch particles and the extruded strands are further treated in accordance with the stage (c).

For the solvent treatment, approximately 90 to 100% of the pitch particles may have a particle size of less than about 0.2 millimeters. Suitable aliphatic solvents which may be used for the solvent treatment include petroleum ether, methanol and benzine, for instance. The separation of the solvent fraction from the insoluble particles may, for example, be accomplished by filtration or decantation.

Carbon strands (1000° C) which have been produced from coal-tar pitch according to the methods described possess tensile strengths of approximately 30 to 45 kilograms per square millimeter and possess a modulus of elasticity of the order of about 1400 kilograms per square millimeter. When used in the form of short or long fibers, for example, such strands are suitable for the reinforcement of synthetic resins.

The advantages of the invention reside particularly in that the individual carbon strands may be produced in an extremely short period of time but yet with a surprisingly high strength.

The following examples are presented to further illustrate the invention and are not intended to limit the same in any manner:

EXAMPLE 1

500 parts by weight of a hard pitch having a Kramer-Sarnow softening point of 150° C is heated to a temperature of 220° C. 25 parts by weight of Kieselguhr is homogeneously mixed in. The pitch melt is introduced into a pressure filter which has been preheated to temperatures between 250° and 280° C and, by means of nitrogen having a pressure of 5 atmospheres, is filtered through a paper sliver filter having openings of an average diameter of 3.4 microns. The filtered pitch melt is then heat treated at a temperature between 280° and 300° C for a period of 3 to 4 hours during which time about 7 parts by weight of low molecular weight pitch components are distilled off. The pitch which remains after the treatment has a softening point of about 185° C. The coal-tar pitch is pressed through an extrusion head by means of nitrogen having a pressure of 2 atmospheres, the pitch being in a molten state and having a temperature of 230° C. In this manner, the pitch is extruded to the form of strands having a diameter of 12 microns. The completed strands are sprinkled with finely divided activated carbon which has been impregnated with 17% by weight of 10% sulfuric acid. The activated carbon has a particle size of 60 microns. The sprinkled strands are placed in an oven and, with air circulation through the oven, are heated to a temperature of 350° C within a period of 20 minutes. Immediately thereafter, the oxidized strands are heated to 1000° C within a further period of 10 minutes while being continuously flushed with nitrogen. With this, the carbonization of the strands is terminated. The individual carbon strands obtained exhibit a tensile strength of 35 kilograms per square millimeter, an elongation at fracture of 1.3% and a modulus of elasticity of 1347 kilograms per square millimeter. All values are averages of at least 5 determinations.

EXAMPLE 2

A hard pitch having a Kramer-Sarnow softening point of 200° C is heated to a temperature of 300° C. The pitch melt is filtered through a paper sliver filter in the manner described in Example 1. The pitch is cooled and the cooled pitch is ground so that 95% of the resulting particles have a size of less than 0.2 millimeters. 100 parts by weight of this pitch is stirred with 100 parts by volume of petroleum ether at room temperature for a period of 180 minutes. The solvent portion of the resulting suspension is filtered off or decanted and a residue of 96.5 parts by weight having a softening point of 205° C is obtained. The thus-obtained pitch residue is heated to a temperature of 290° and the pitch melt is extruded in the manner described in Example 1. The resulting strands are sprinkled with activated carbon which has been impregnated with bromine and the further thermal treatment is likewise carried out as described in Example 1. The individual carbon strands obtained exhibit, on the average, a tensile strength of about 40 kilograms per square millimeter, an elongation at fracture of 1.1% and a modulus of elasticity of about 1400 kilograms per square millimeter.

It may be seen that, despite the extremely short treatment times obtainable in accordance with the invention, the invention enables carbon strands having adequate tensile strength, and possessing other desired properties to a large degree, to be produced from commercial hard coal-tar pitches.

It will be understood that each of the elements described above, or two or more together, may also find a useful application in other types of articles differing from the types described above.

While the invention has been illustrated and described as embodied in a method for the production of carbonaceous strands, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for the production of carbonaceous articles, comprising heating pitch to such a temperature above its softening point that a first part of said pitch becomes molten and a second part of said pitch is in the form of substantially non-molten particles; thereafter separating said first part of said pitch and at least the major part of said particles from one another so as to cause said first part of said pitch to become more homogeneous; treating said first part of said pitch so as to increase the molecular weight thereof; shaping said first part of said pitch subsequent to said separation and said treatment so as to form at least one article therefrom; contacting said article with finely divided activated carbon which is impregnated with an oxidizing agent; oxidizing said article in the presence of said activated carbon so as to increase the melt-resistance of said article; and carbonizing said article.

2. A method as defined in claim 1, wherein said article is graphitized.

3. A method as defined in claim 1, said pitch comprising coal-tar pitch, and said coal-tar pitch being a hard pitch having a Kramer-Sarnow softening point between about 70° and 190° C; and wherein said heating comprises raising the temperature of said pitch to the range of about 40° to 100° C above the softening point thereof, said separation being carried out while said first part of said pitch has a temperature in said range.

4. A method as defined in claim 1, wherein said separation comprises filtering under a pressure greater than atmospheric pressure so as to effect substantially complete separation of said first part of said pitch from said particles.

5. A method as defined in claim 1, wherein said treatment being carried out subsequent to said separation; and wherein said treatment comprises subjecting said first part of said pitch to a distillation at temperatures between about 280° and 350° so as to effect removal of low molecular weight components of said pitch from said first part thereof.

6. A method as defined in claim 1, wherein said shaping comprises extruding said first part of said pitch to the form of at least one strand while said first part of said pitch is in a molten state.

7. A method as defined in claim 1, said activated carbon being impregnated with a liquid oxidizing agent, and said contacting comprising dusting said article with said activated carbon; and wherein said oxidation is carried out in an oxidizing atmosphere at temperatures between about 300° and 400° C.

8. A method as defined in claim 1, wherein said oxidizing agent comprises at least one member of the group consisting of nitroaromatic compounds and compounds which generate oxidizing gases at elevated temperatures.

9. A method as defined in claim 1, wherein said pitch has a Kramer-Sarnow softening point between about 70° and 190° C and said treatment comprises subjecting said first part of said pitch to a distillation at temperatures between about 280° and 350° C so as to effect removal of low molecular weight components of said pitch from said first part thereof.

10. A method as defined in claim 8, wherein said oxidizing agent comprises at least one member of the group consisting of nitrobenzene, nitrotoluene, nitrophenol, bromine and sulfuric acid.

* * * * *